United States Patent [19]

Olavesen et al.

[11] 4,124,650

[45] Nov. 7, 1978

[54] PROCESS FOR THE PRODUCTION OF LOW POUR POINT SYNTHETIC OILS

[75] Inventors: Christopher Olavesen; Bruce M. Sankey; John B. Gilbert, all of Sarnia, Canada

[73] Assignee: Exxon Research & Engineering Co., Linden, N.J.

[21] Appl. No.: 818,101

[22] Filed: Jul. 22, 1977

[51] Int. Cl.[2] ..... C07C 9/14

[52] U.S. Cl. ..... 260/676 R; 208/111; 252/59; 260/683.1; 260/683.9

[58] Field of Search ..... 208/111; 260/676 R, 260/683.1, 683.9

[56] References Cited

U.S. PATENT DOCUMENTS

| | | | |
|---|---|---|---|
| 2,500,166 | 3/1950 | Seger et al. | 260/683.1 |
| 3,438,887 | 4/1969 | Morris et al. | 208/87 |
| 3,516,925 | 6/1970 | Lawrence et al. | 208/111 |
| 3,883,417 | 5/1975 | Woo et al. | 208/49 |

*Primary Examiner*—C. Davis

*Attorney, Agent, or Firm*—Edward M. Corcoran

[57] ABSTRACT

An improved process for producing low pour point, high VI synthetic oils from feedstocks containing wax and residual olefinic unsaturation, said feedstocks having been obtained by thermal, non-catalytic polymerization of linear, $C_6$–$C_{20}$ carbon atom monoalpha-olefins. The improvement comprises simultaneously hydrogenating and catalytically dewaxing the feedstock by contacting said feedstock and hydrogen with a hydrogen form mordenite catalyst at elevated temperature and pressure, thereby producing a stable synthetic oil of high viscosity index and low pour point.

18 Claims, No Drawings

PROCESS FOR THE PRODUCTION OF LOW POUR POINT SYNTHETIC OILS

BACKGROUND OF THE INVENTION

1. Field of the Invention

This invention relates to an improved process for producing stable, low pour point synthetic oils. More particularly, this invention relates to an improved process for producing low pour point, stable oils of high VI from synthetic oil feedstocks containing wax and olefinic unsaturation wherein the improvement comprises simultaneously hydrogenating and catalytically dewaxing the feedstock over a mordenite catalyst. Still more particularly, this invention relates to an improved process for the production of low pour point, high VI, stable, synthetic oils from feedstocks derived by thermally and non-catalytically polymerizing a mixture of linear $C_6$–$C_{20}$ carbon atom monoalpha-olefins, wherein the improvement comprises simultaneously saturating residual olefinic bonds and removing at least a portion of the wax from the feedstock by contacting said feedstock and hydrogen with a hydrogen form mordenite catalyst thereby producing a stable, high VI, synthetic oil of low pour point. 2. Description of the Prior Art It is well known that synthetic oils of high viscosity index can be produced by polymerizing straight chain monoalpha-olefins. Synthetic lubricating oils of both high VI (viscosity index) and low pour point are made by polymerizing a relatively pure, narrow-cut monoalpha-olefin having 6 to 14 carbon atoms in the chain over an aluminum chloride catalyst in the presence of hydrogen. Lube oils produced by this process generally have a VI of over 130 with a pour point of −60° F. or lower which makes them especially useful for specialty service such as lubricating aviation turbines. However, both feed and production costs are relatively high with this process.

It is also known that synthetic oils having a relatively high VI can be produced by thermal, non-catalytic polymerization of a relatively broad-cut or smear of straight chain monoalpha-olefins. Such processes are disclosed, for example, in U.S. Pat. No. 2,500,166 and U.S. Pat. No. 3,883,417, the disclosures of which are incorporated herein by reference. Thus, the '166 patent teaches a method for thermally and non-catalytically polymerizing a $C_6$–$C_{12}$ carbon atom mixture of linear or normal monoalpha-olefins while the '417 patent relates to a two-stage, thermal, non-catalytic process for polymerizing a mixture of $C_5$–$C_{20}$ carbon atom monoalpha-olefins. Both of these processes produce a synthetic lubricating oil having a VI in excess of 100. Unfortunately, however, although synthetic lubricating oils produced by thermal, non-catalytic polymerization of these linear monoalpha-olefin mixtures have high VI's in excess of 100, they also contain considerable amounts of wax which is reflected in pour points above 0° F. and they also contain olefinic unsaturation which contributes to poor oxidation stability. Therefore, these oils must be both dewaxed and hydrogenated in order to convert them into useful products.

At least two disadvantages are associated with conventional hydrogenation and dewaxing of these thermally, non-catalytically polymerized synthetic oils. In the first place, it has been found that hydrogenating these oils with conventional hydrogenating catalysts such as cobalt molybdate, nickel molybdate or nickel-tungsten on alumina significantly increases the wax content of the oil and in the second place, it is technologically unfeasible and uneconomical to solvent dewax an oil down to a pour point of −60° F. or lower. Therefore, it would be a significant improvement to the art if an efficient and economical method could be found for stabilizing and dewaxing synthetic lube oils produced by the thermal, non-catalytic polymerization of mixtures of linear, monoalpha-olefins.

SUMMARY OF THE INVENTION

An improved process has now been found for producing low pour point, synthetic oils from feedstocks containing wax and residual olefinic unsaturation, said feedstocks having been obtained by thermal, non-catalytic polymerization of mixtures of linear $C_6$–$C_{20}$ carbon atom monoalpha-olefins, wherein the improvement comprises simultaneously hydrogenating and catalytically dewaxing said feedstock by contacting same and hydrogen with a hydrogen form mordenite catalyst at elevated temperature and pressure to produce a stable oil having a low pour point and a high VI. The thermal, non-catalytically polymerized synthetic oil feedstocks useful in this invention will hereinafter be referred to as TPO's for the sake of convenience.

Catalytically dewaxing petroleum oil fractions over decationized or hydrogen form mordenite is well known in the art. However, it was not known that hydrogen form mordenite would simultaneously hydrogenate and catalytically dewax TPO and do so without a substantial loss in VI which occurs when catalytically dewaxing paraffinic lube oil fractions derived from crude oils. Further, it has been unexpectedly found that the selectivity of hydrogen form mordenite for catalytically dewaxing TPO is much greater than that exhibited for dewaxing paraffinic petroleum fractions derived from crude oils, which is reflected in a substantially higher yield of dewaxed product with the TPO as compared to a paraffinic fraction of a crude.

As hereinbefore stated, supra, suitable process for obtaining such feedstocks are well known in the art and include processes such as those disclosed in U.S. Pat. Nos. 2,500,166 and 3,883,417. These TPO feedstocks will boil within the range of from about 500° to over 1050° F. at atmospheric pressure and more preferably from 550° to 850° F. where specialty oils of low viscosity and exceptionally low pour point are desired, such as aviation turbine oils, refrigerator oils, transformer oils and other electrical insulating oils. In the case where oils such as automotive lubricating oils are desired, the feedstocks will boil within the range of from about 600° to 1050° F. These feedstocks will generally have a VI above about 110, more preferably at least about 120, and will contain appreciable amounts of wax as reflected in pour points above about 0° F. and even above about +50° F. in some cases. The amount of olefinic unsaturation present in such feedstocks will average about one double bond per molecule of oil and is reflected in a feedstock Bromine Number ranging from about 10 to 20. Although suitable TPO feedstocks may be obtained by the thermal, noncatalytic polymerization of mixtures of straight chain or linear $C_6$–$C_{20}$ carbon atom monoalpha-olefins, preferred feedstocks are obtained by polymerizing mixtures of linear $C_{10}$–$C_{14}$ carbon atom monoalpha-olefins.

The decationized or hydrogen form mordenite catalyst useful in this invention preferably contains one or more catalytic metal hydrogenating components selected from the group consisting of Group VI metals, Group VIII metals, their oxides, sulfides and mixtures thereof. Preferably, the catalytic metal component of the catalyst is a platinum group metal, particularly platinum or palladium and may be added by any of the well known methods such as ion exchange or impregnation. The amount of platinum group metal added to the catalyst is preferably within the range of 0.05 to 10.0 wt.%, more preferably 0.1 to 5.0 wt.% and most preferably 0.2 to 2.0 wt.% calculated as metal and based on the total weight (dry basis) of the catalyst. Iron group metals such as nickel also give useful results and they may be used in greater amounts than the platinum group metals, preferably within the range of 0.1 to 50.0 wt.% and more preferably 1.0 to 20.0 wt.% calculated as metal and based on the total weight (dry basis) of the catalyst. Mixtures of certain Group VI and Group VIII metals and compounds may also be used, for example, such as cobalt and molybdenum. Finally, it may be advantageous to incorporate into the catalyst multivalent metals of Group II and Group III in addition to one or more metals of Group VI and/or Group VIII.

It is well known in the art that by hydrogen form or decationized mordenite is meant that the exchangeable metal cation, such as sodium, is replaced with hydrogen in an amount such that the resulting hydrogen form mordenite will have a sodium content of less than 5 and more preferably less than about 2 wt.%. The hydrogen form mordenite may be produced in well known manners such as by ion exchange of the sodium in the mordenite with ammonium ion followed by heating or calcining to drive off ammonia. Another effective method of producing hydrogen form mordenite is by acid treatment with a mineral acid.

Suitable process conditions for the simultaneous dewaxing-hydrogenation of this invention include temperatures within the broad range of 450° to 950° F., preferably 500° to 850° F. and still more preferably 500° to 750° F.; hydrogen pressures within the range of 100 to 5000 psig and more preferably in the range of 200 to 2500 psig; a space velocity ranging between about 0.1 to 20.0 liquid volumes per hour per volume of catalyst (V/h/V) and preferably 0.15 to 5.0 V/h/V and hydrogen feed rates in the range of 100 to 20,000 SCF/B (standard cubic feet per barrel of feed) and more preferably 500 to 10,000 SCF/B.

Description of the Preferred Embodiments

The following comparative example further illustrates the present invention.

COMPARATIVE EXAMPLE

In this example, a raw, untreated TPO feedstock is contacted with a noble metal on a hydrogen form mordenite catalyst, in the presence of hydrogen and the results are compared with conventionally hydrotreating the same TPO feedstock as well as treating a paraffinic distillate derived from a natural crude oil with a noble metal on a hydrogen form mordenite catalyst.

A commercially available hydrogen form mordenite sold under the name of Zeolon 900-H by the Norton Chemical Company was treated with ammonium nitrate solution and calcined to produce a hydrogen mordenite containing less than 0.1 wt.% residual sodium. Platinum is an amount of 0.5 wt.% of the total catalyst (dry basis) was added to the mordenite by aqueous impregnation with a solution of chloroplatinic acid followed by washing and calcination in air at 950° F. The platinum containing catalyst was then reduced by treating with hydrogen at 700°F. and 1350 psig hydrogen pressure for 4 hours prior to use. The catalyst was used to treat various petroleum derived, sulfur-containing feedstocks for more than 1000 hours prior to the experiment with the TPO.

The feedstock used in this experiment was a raw or untreated TPO boiling in the range of from 700° to 1025° F. which was produced from a $C_{10}$–$C_{14}$ mixture of linear, monoalpha-olefins derived from steam cracking a paraffin wax. This feed was passed over the platinum containing mordenite catalyst in the presence of hydrogen.

Another sample of the same TPO feed was conventionally hydrotreated over a nickel molybdate on alumina catalyst and a light, conventional lube oil distillate was catalytically dewaxed over a noble metal on hydrogen form mordenite catalyst. The data for the TPO feed and products are shown in Table 1 while Table 2 contains the data for the light lube distillate.

The data in Table 1 clearly illustrate the simultaneous saturation in olefin content and reduction in pour point (wax content) with little loss in VI when the TPO was treated in accordance with this invention. It also illustrates the increase in wax content which occurs when the TPO is conventionally hydrogenated. Comparing the data in Table 2 with that in Table 1 illustrates the unexpected selectivity (yield-pour point relationship) of the hydrogen form mordenite with the TPO and the dramatic loss in VI with the crude oil distillate.

TABLE 1

Conventional Hydrogenation of TPO Compared with Simultaneous Hydrogenation/Catalytic Dewaxing of TPO

| | TPO Feed | Conventional Hydrogenation(1) | Simultaneous Hydrogenation/Catalytic Dewaxing(2) |
|---|---|---|---|
| Yield on Feed, LV% | 100 | 100 | 60 |
| Viscosity, cSt/100° F | 19.8 | 20.8 | 29.4 |
| Viscosity, cSt/210° F | 4.3 | 4.5 | 5.4 |
| Viscosity Index (VI) | 139 | 143 | 131 |
| Density, kg/dm$^3$,15° C | 0.842 | 0.838 | 0.848 |
| Pour, ° F (ASTM) | +45 | +70 | −35 |
| Cloud, ° F (ASTM) | +60 | +88 | −20 |
| Aromatics, Wt.% (silica gel) | 9.5 | 5.2 | 4.8 |
| Bromine Number | 16.4 | 0.1 | 0.4 |

(1)Catalyst: Cyanamid Aero HDS-9A (nickel molybdate on alumina) Reactor Conditions: 800 psig $H_2$, 2000 scf $H_2$/Bbl, 1 v/h/v, 550° F (2)Reactor Conditions: 1350 psig hydrogen, 5000 scf hydrogen/Bbl, 575° F, 0.17 v/h/v, product stripped at 175° F, 10 mm Hg. Catalyst is 0.5 wt.% Pt. on H-mordenite.

TABLE 2

CATALYTIC DEWAXING OF PETROLEUM DERIVED FEEDSTOCK

| | SAE 5 Grade Raffinate | |
|---|---|---|
| | Feed(1) | Product(2) |
| Yield on Feed, LV% | 100 | 48 |
| Viscosity, cSt, 100° F | 17.5 | 41.8 |
| Viscosity, cSt, 210° F | 3.7 | 5.3 |
| Viscosity Index (VI) | 104 | 39 |
| Density, Kg/dm$^3$, 15° C | 0.864 | 0.901 |
| Pour, ° F (ASTM) | 79 | −25 |
| Cloud, ° F (ASTM) | — | — |
| Aromatics, Wt.% (silica gel) | — | — |
| Bromine Number | — | — |

(1)Derived from Leduc (Western Canadian) crude, boiling range 610–850° F at atmospheric pressure.

(2)Reactor conditions: 1350 psig $H_2$, 0.5 v/h/v, 5000 scf $H_2$/Bbl, 550° F. Product Stripped at 300° F and 10 mm HgCatalyst: Hydrogen mordenite, Na content reduced to less than 0.1 Wt.% by ammonium nitrate treating and calcination, impregnated with palladium chloride solution to give 0.25 Wt.% palladium on catalyst, calcined in air at 1000° F for 1 hour and reduced at 650° F and 1350 psig $H_2$ for 4 hours. Catalyst pretreated for 150 hours with sulfur containing distillate.

What is claimed is:

1. An improved process for producing low pour point synthetic oils from feedstocks containing wax and residual olefinic unsaturation, said feedstocks having been obtained by thermally and non-catalytically polymerizing a mixture of linear $C_6$–$C_{20}$ carbon atom monoalpha-olefins, wherein the improvement comprises simultaneously hydrogenating and catalytically dewaxing said feedstock by contacting same and hydrogen with a catalyst comprising a hydrogen form mordenite at elevated temperature ranging from between about 450° to 950°F. and at elevated pressure, thereby producing a synthetic oil of reduced wax content and pour point.

2. The process of claim 1, wherein catalyst contains one or more metal hydrogenating component selected from the group consisting of Group VI metals, Group VIII metals, their oxides, sulfides and mixtures thereof.

3. The process of claim 2 wherein said feedstock boils within the range of from about 500° to 1100° F.

4. The process of claim 3, wherein said catalyst contains at least one platinum group metal.

5. The process of claim 4, wherein said metal is present on said catalyst in an amount ranging from about 0.05 to about 10.0 wt.% based on the total dry weight of the catalyst.

6. The process of claim 5 wherein said metal is platinum or palladium.

7. The process of claim 6 wherein said feedstock and product have a VI of at least 120.

8. The process of claim 7 wherein the pour point of said product is no greater than about 0° F.

9. An improved process for producing low pour point synthetic oils from feedstocks containing wax and residual unsaturation, said feedstocks having been obtained by thermal, non-catalytic polymerization of a mixture of linear $C_6$–$C_{20}$ carbon atom monoalpha-olefins, wherein the improvement comprises simultaneously hydrogenating and catalytically dewaxing the feedstock by contacting same and hydrogen with a catalyst comprising a hydrogen form mordenite containing one or more metal hydrogenating components at elevated temperature and pressure ranging from about 450° to 950° F. and 100 to 5000 psig of hydrogen, respectively, to produce a stable synthetic oil of reduced wax content and pour point.

10. The process of claim 9 wherein said metal hydrogenating component is selected from the group consisting of Group VI metals, Group VIII metals, their oxides, sulfides and mixtures thereof.

11. The process of claim 10, wherein said elevated temperature and pressure range from about 500° to 850° F. and 200 to 2500 psig of hydrogen, respectively.

12. The process of claim 11 wherein said feedstock has an initial boiling point of about 500° F.

13. The process of claim 12 wherein said feedstock has a Bromine Number ranging from about 10 to 20.

14. The process of claim 13 wherein both said feedstock and product have a VI of at least about 120.

15. The process of claim 14 wherein said metal is a platinum group metal present on said catalyst in an amount ranging from 0.05 to 10.0 wt.% based on the total dry weight of the catalyst.

16. The process of claim 15, wherein said feedstock is obtained by thermally and non-catalytically polymerizing a mixture of linear $C_{10}$–$C_{14}$ carbon atom monoalpha-olefins.

17. The process of claim 16 wherein said feedstock boils within the range of 500° to 1100° F.

18. The process of claim 17 wherein the pour point of said product is below about 0° F.

* * * * *